US006481586B1

(12) United States Patent
Hoff

(10) Patent No.: US 6,481,586 B1
(45) Date of Patent: Nov. 19, 2002

(54) REVERSIBLE SHELVING UNIT

(76) Inventor: David A. Hoff, 94 Shoreview Dr., Cottonwood, MN (US) 56229

( * ) Notice: Subject to any disclaimer, the term of this patent is extended or adjusted under 35 U.S.C. 154(b) by 0 days.

(21) Appl. No.: 09/935,954

(22) Filed: Aug. 23, 2001

Related U.S. Application Data

(60) Provisional application No. 60/227,245, filed on Aug. 23, 2000.

(51) Int. Cl.[7] ..... A47F 5/08
(52) U.S. Cl. ..... 211/90.02
(58) Field of Search ..... 211/90.02, 90.04, 211/187, 144, 163; 312/305; 108/94

(56) References Cited

U.S. PATENT DOCUMENTS

| | | | | |
|---|---|---|---|---|
| 264,747 A | | 9/1882 | Potts | |
| 2,840,438 A | * | 6/1958 | Sharpe | 126/338 |
| 2,905,518 A | | 9/1959 | Doesken | |
| 3,868,157 A | | 2/1975 | Robinson | |
| 4,124,262 A | | 11/1978 | Schill | |
| 4,433,885 A | * | 2/1984 | Baker | 312/125 |
| 4,486,106 A | | 12/1984 | Benting | |
| 4,587,908 A | | 5/1986 | DeBruyn | |
| 4,616,940 A | | 10/1986 | DeBruyn | |
| 5,312,003 A | * | 5/1994 | Domenig | 211/131.1 |

FOREIGN PATENT DOCUMENTS

| | | |
|---|---|---|
| CA | 1111890 | 11/1981 |
| DE | 357915 | 9/1922 |

* cited by examiner

*Primary Examiner*—Alvin Chin-Shue
*Assistant Examiner*—Sarah Purol
(74) *Attorney, Agent, or Firm*—Haugen Law Firm PLLP

(57) ABSTRACT

A reversibly positionable shelving unit housed within a cabinet enclosure and consisting of a frame with opposed top, bottom, and intermediate supports, each with a laterally disposed support post engaging channel formed therein. An upright spine or support post is rigidly secured to and extends between the top and bottom supports, and is disposed adjacent one lateral edge surface of the supports medially between opposed front and rear edge plate surfaces, with the outer surfaces of the supports having track followers coupled thereto. Camming support means are coupled to each support, and adapted to releasably, frictionally and grippingly engage the edge of the spine to lock the shelves in cantilevered support with the spine. Matching upper and lower guide slots are formed in the enclosure for engaging the follower means, with a linear bearing secured to the lower panel and in engagement with the undersurface of the bottom-most support.

2 Claims, 11 Drawing Sheets

REVERSIBLE SHELVING UNIT

CROSS-REFERENCE TO RELATED APPLICATION

This application constitutes a utility application to my Provisional Application Ser. No. 60/227,245, filed Aug. 23, 2000, entitled "REVERSIBLE SHELVING UNIT".

BACKGROUND OF THE INVENTION

The present invention relates generally to an improved reversibly positionable shelving unit of rectangular configuration adapted to be housed within a conventional shelf or cabinet enclosure, and more particularly to such reversible shelving unit which is stable, durable, and incorporates a framing spine with upper and lower support members having one or more individual shelves adjustably positionable along the framing spine. Even though the individual shelves included in the assembly are open across at least a substantial portion of their width, the shelving units are well adapted to carry heavy loads. They are adapted for use in both residential and commercial installations.

In the past, reversible shelving units have been utilized which typically incorporate a central panel which panel in use, effectively isolates one segment of the shelving units from the other. Such units typically incorporate a center panel which make adjustable positioning of the shelves an inconvenient task. When such a central panel is removed to permit greater open or through-access across the shelves, the resulting structures have been found to lack stability, and become susceptible to either racking and/or parallelogramming when under heavy loading. Alternatively, reversible shelving units may incorporate one or two end panels which, in turn, eliminate or substantially reduce open or through-access across the surface of the shelves.

Reversible shelving units typically incorporate upper and lower guide slots which are designed to engage followers coupled to parts of the reversible structure. These guide slots have typically included a central arcuate portion flanked by linear portions or segments which extend at an acute angle relative to the longitudinal axis of the unit, and terminate near the edge surfaces of the unit. The present invention provides an improved configuration for guide slots, which configuration adds and contributes to enhanced stability and rigidity for the reversible unit. In accordance with the present invention, however, the guide slots are modified so that the distal end portions each extend along an axis generally parallel to the longitudinal axis of the unit. It is this configuration which provides additional stability when the unit is disposed in its normal or closed position. Additionally, an adjustable set screw which functions to control the level of the bottom-most shelf may be conveniently employed for leveling the shelving unit in order to preserve smooth actuation and operation of the entire assembly when under heavy load conditions.

SUMMARY OF THE INVENTION

One advantageous feature of the present invention is to provide a plurality of shelves which are fully, conveniently and adjustably positionable in vertically spaced relationships, one to another within the reversible unit. This feature is accomplished by means of providing the edge mounted spine or upright post, with each shelf being coupled to the spine by means of a spring biased eccentric. The eccentric releasably engages one surface, preferably an edge surface of the spine for locking the shelf in unidirectional cantilevered support along the post or spine. Each eccentric is further provided with finger actuated release levers, thus enabling the user to readily and easily reposition the shelves vertically whenever necessary and/or appropriate.

The assemblies prepared in accordance with the present invention incorporate a bottom or primary shelf assembly support bracket. This bracket is designed to both support a shelf unit, as well as to provide cam follower features which follow a path determined by the configuration of the lower guide slots which function in combination with the lower linear bearing or bearing assembly. Since this bracket provides primary support for the spine as well as the entire structure during the articulation of the reversible assembly, it is necessarily rugged and capable of withstanding significant forces during actual use. In order to achieve the necessary rigidity, this bracket is provided with upstanding brackets or reinforcing ribs which are conveniently configured in the form of one or more receptacles, and thus provide a convenient, ready and accessible depository for those items which are frequently referred to by the user, such as recipes and the like.

The under-surface of the primary support bracket necessarily includes a pair of cam or guide followers, the first one of which engages the lower guide slots and the other the linear bearing. The first one of these cam followers is positioned adjacent a lateral edge beneath the support post, and with the other being centrally located and engaged with the linear bearing assembly. In order for this support bracket to accommodate shelving of various widths, a plurality of linear bearing assembly followers are molded into the bracket. When the requirements for the bracket have been determined, those follower structures which are preformed in the assembly and which are not needed are simply removed by any convenient means, including a sawing operation, a milling operation or the like. Thus, multiple-use brackets may be formed from a single mold or tooling, and individually configured for use once the application requirements have been determined.

Therefore, it is a primary object of the present invention to provide an improved reversibly positionable shelving unit housed within an enclosure, and wherein the unit is stable, rugged, and designed for convenient rotary motion, with the individual shelves being open across their depth so as to facilitate convenient loading and unloading during use.

It is a further object of the present invention to provide an improved reversibly positionable shelving unit which is provided with a vertical spine or support post means which exposes at least a substantial portion of the shelves to open viewing across their depth, while also providing for resistance to racking and/or parallelogramming when the structure is under load.

It is yet a further object of the present invention to provide an improved reversibly positionable shelving unit which employs an edge mounted vertical support for receiving and anchoring shelves along one edge of the assembly, and with the shelves each being provided with a spring biased eccentric for facilitating convenient adjustable positioning of the shelves along a vertical axis.

It is yet a further object of the present invention to provide an improved reversible shelving unit arranged to be housed within an enclosure, and with the enclosure including upper and lower panels with upper and lower guide slots associated therewith, the guide slots being formed in the enclosure and being adapted to engage follower means associated with opposed top and bottom support members or plates of the reversible shelving unit.

It is yet a further object of the present invention to provide an improved reversibly positionable shelving unit having slot follower means for controllably guiding the motion of the shelving unit through the motion path defined by matching upper and lower guide slots external to the shelving unit.

It is yet a further object of the present invention to provide an improved reversibly positional shelving unit having a plurality of horizontally disposed shelves coupled to an edge-mounted spine, and wherein means are provided for maintaining consistent operation of the unit even when under heavy load conditions, with these means including an adjustable leveling device for adjustably leveling the lowermost shelf to preserve smooth actuation and motion of the heavily loaded assembly.

Other and further objects of the present invention will become apparent to those of skill in the art upon a review of the following specification and accompanying drawings.

IN THE DRAWINGS

Figure 1:
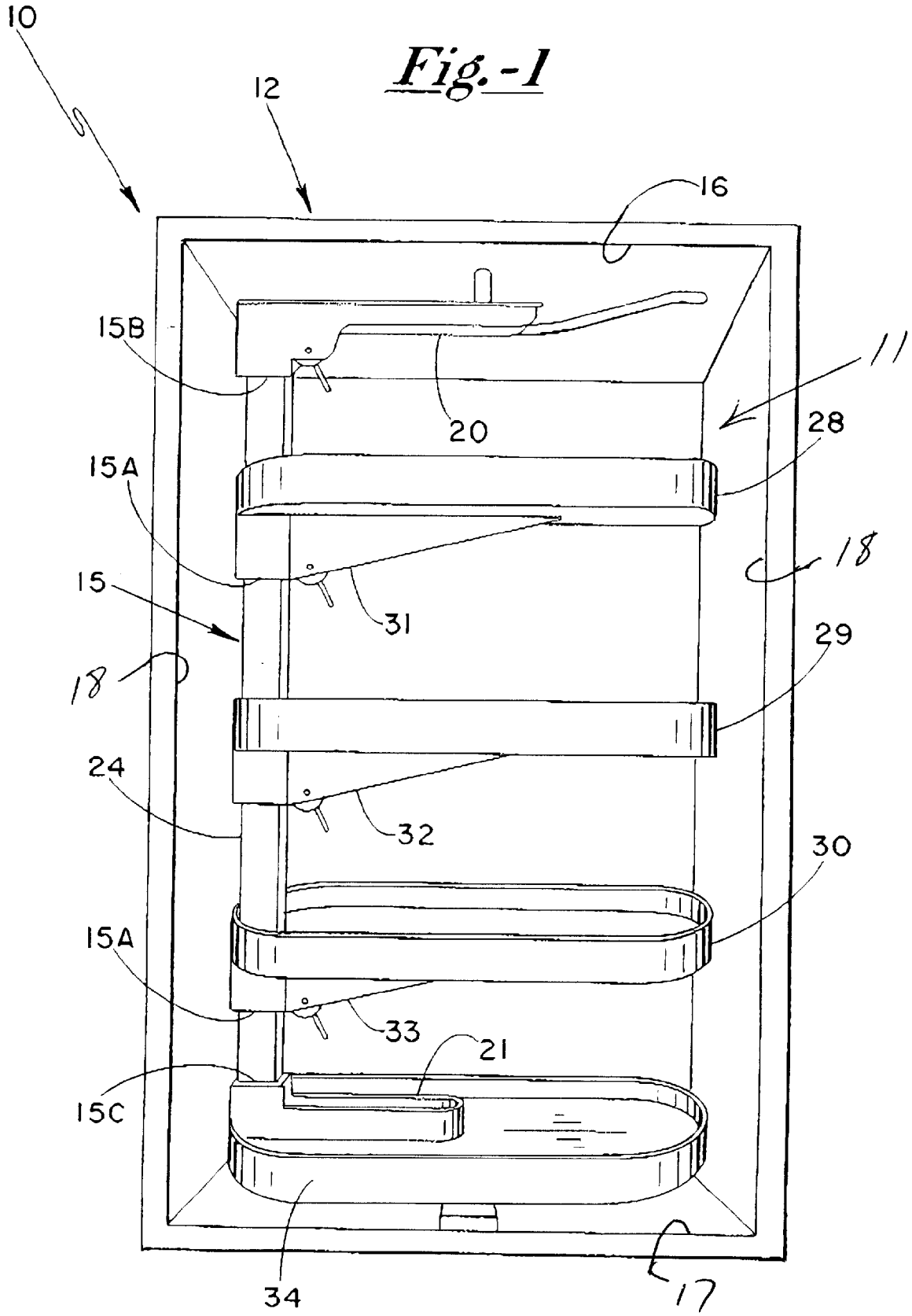
FIG. 1 is a front perspective view of a reversible shelving unit of the invention housed within a conventional cabinet enclosure, with the doors of the enclosure being removed to expose the reversible unit as positioned normally therewithin.
Figure 3:
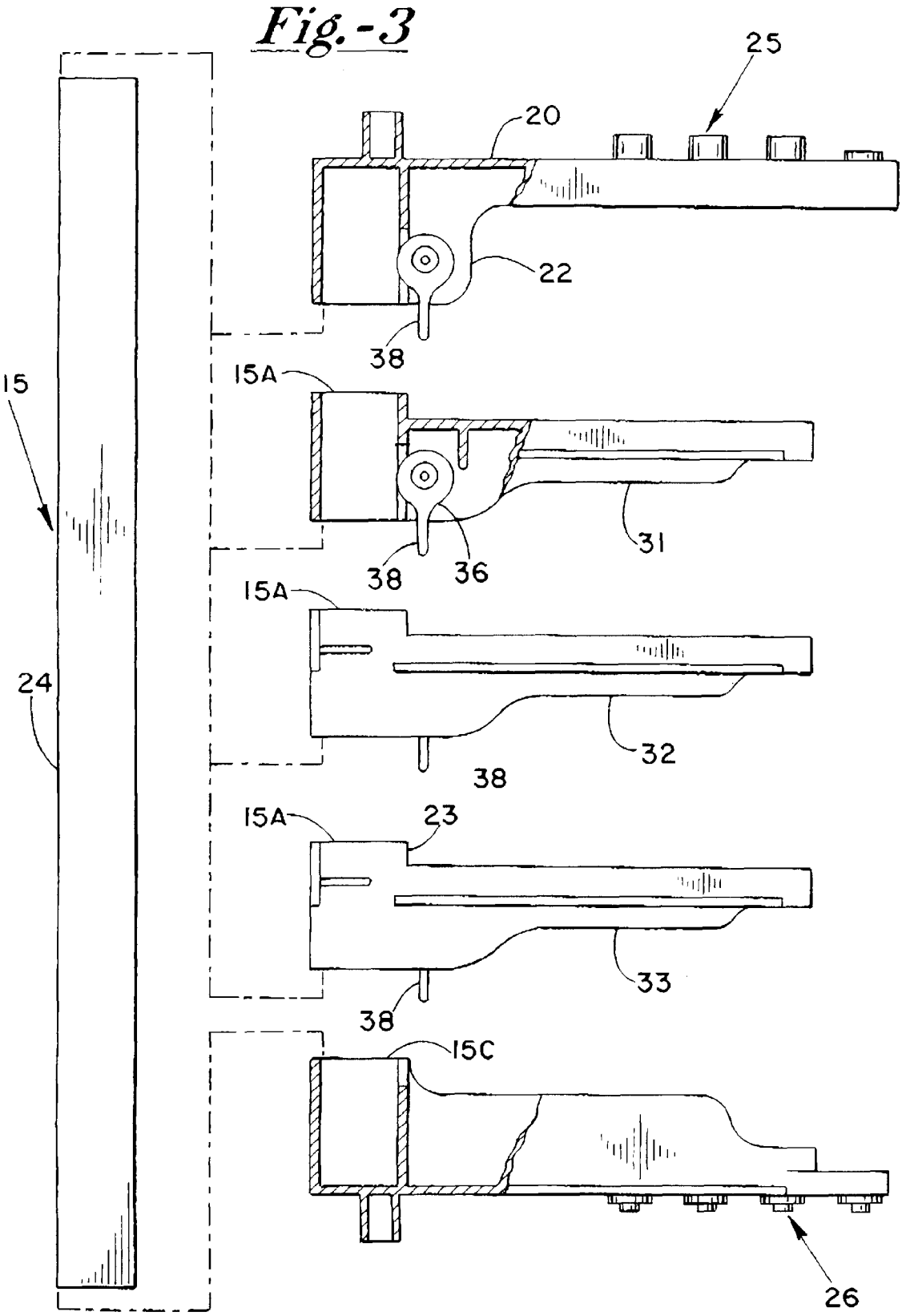
Figure 5:
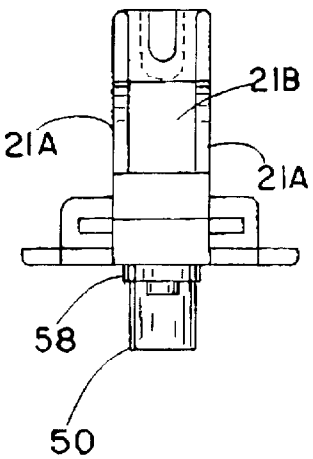
Figure 4:
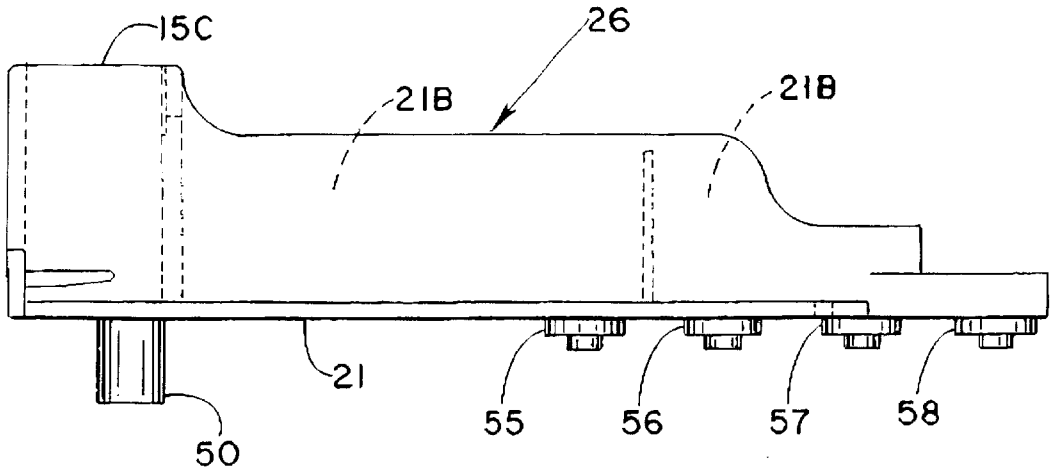
Figure 6:
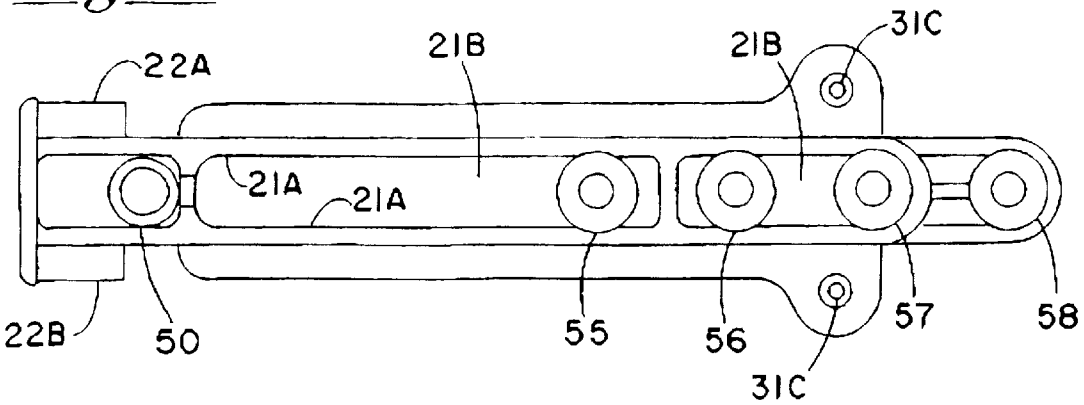
Figures 4A, 5A:
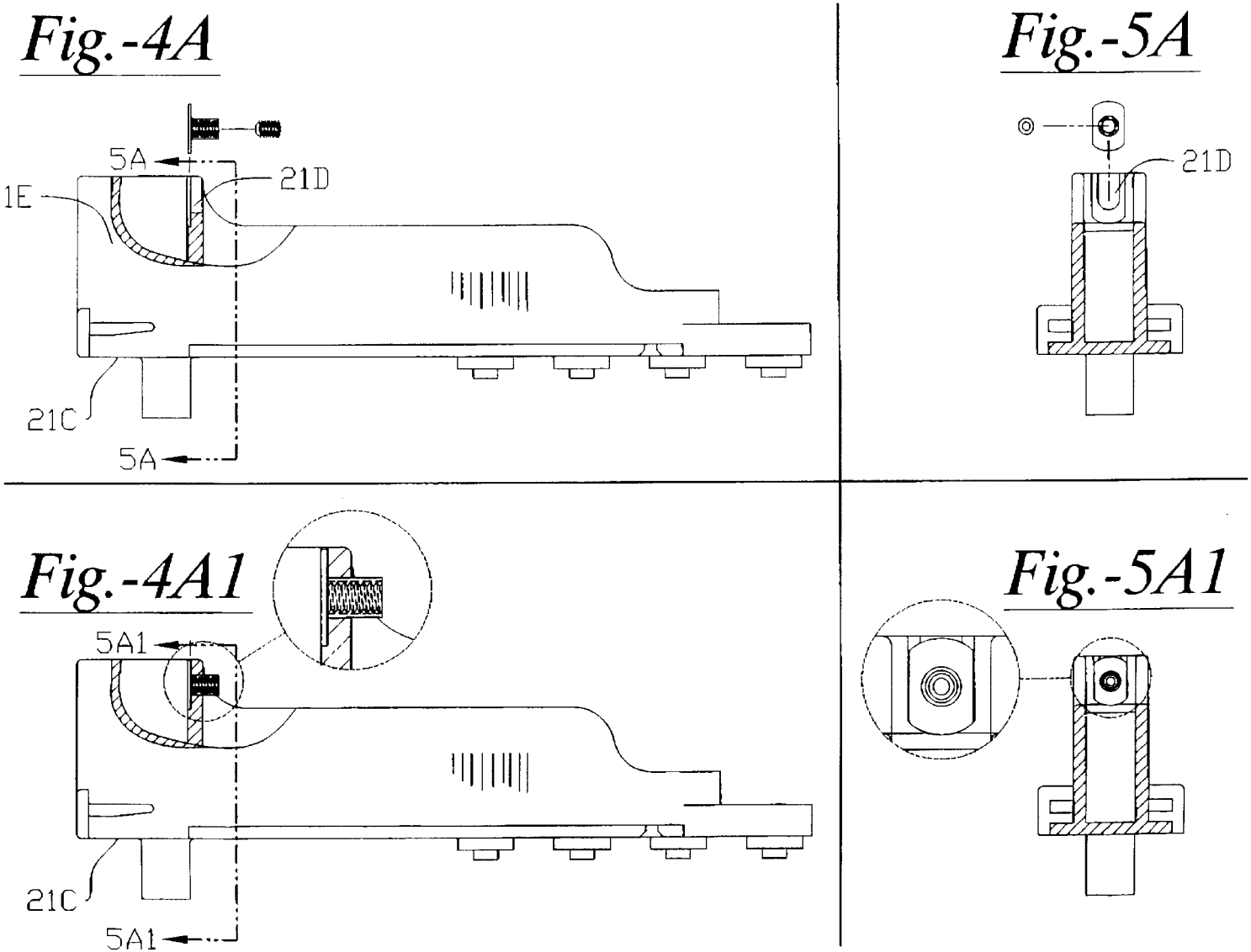
Figure 8:
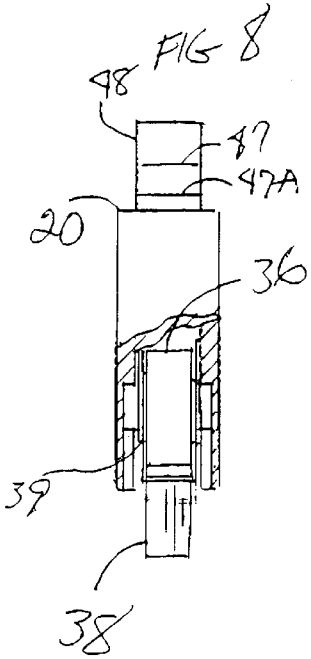
Figure 7:
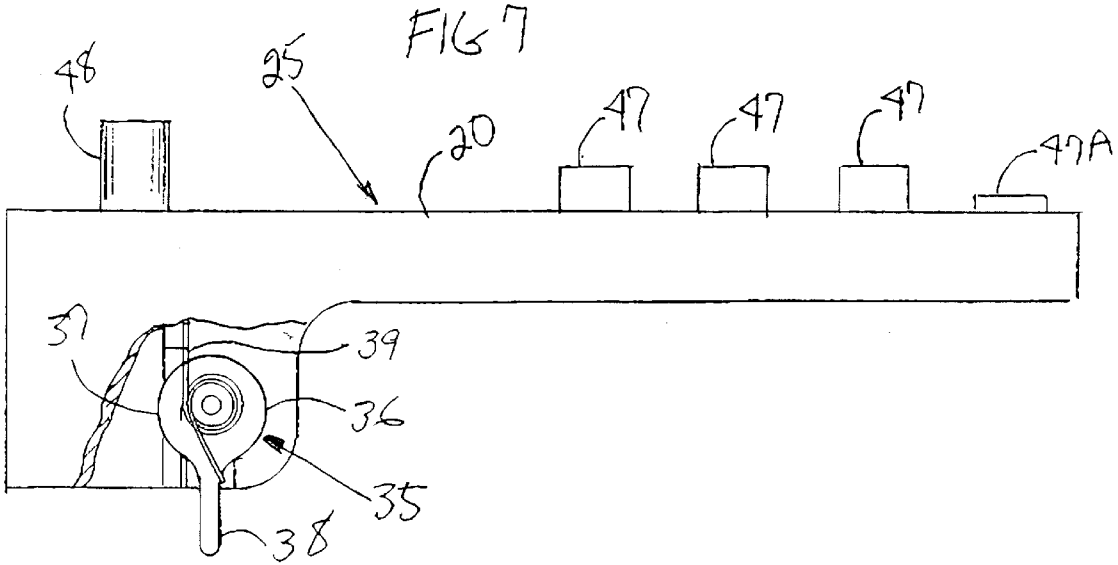
Figure 9:
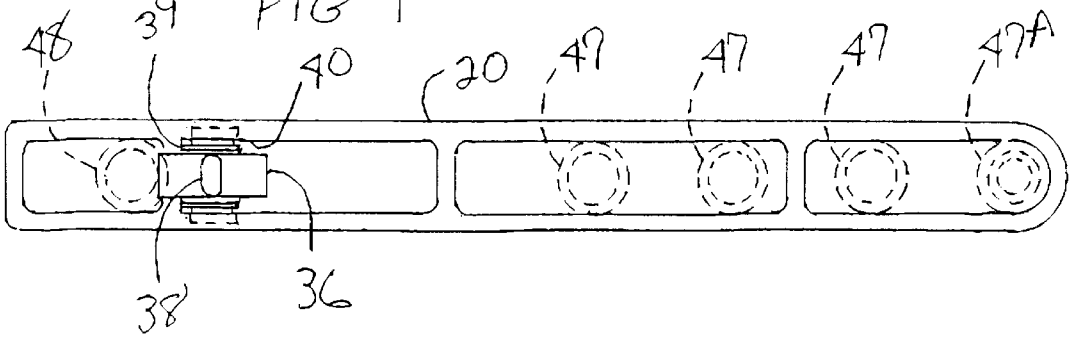
Figure 11:
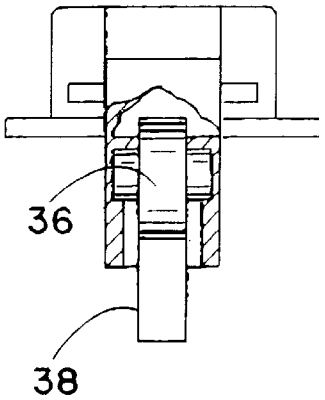
Figure 10:
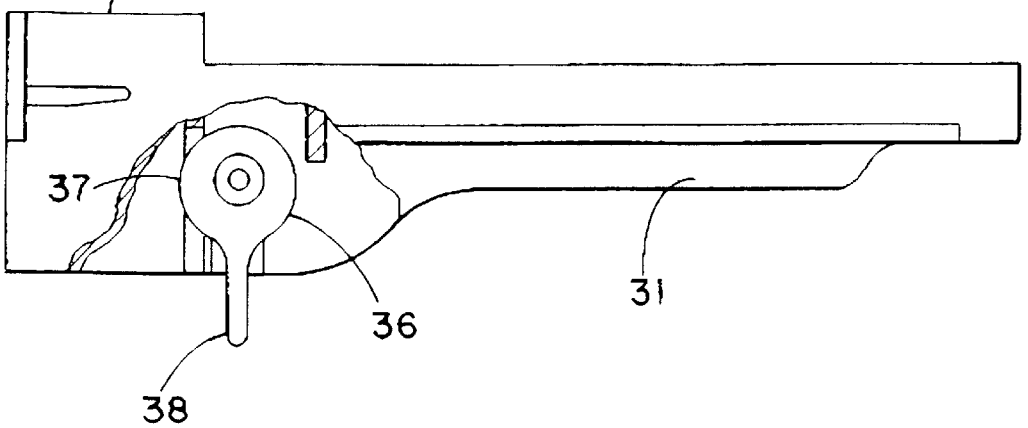
Figure 12:
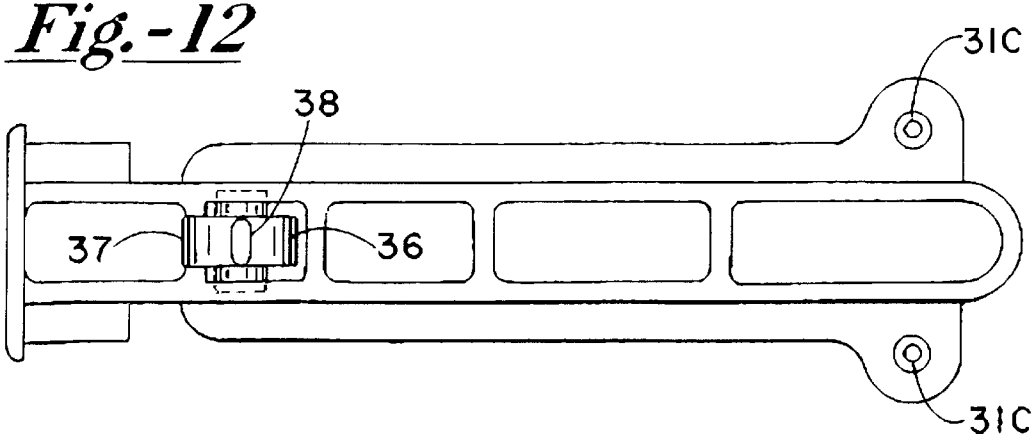
Figure 13:
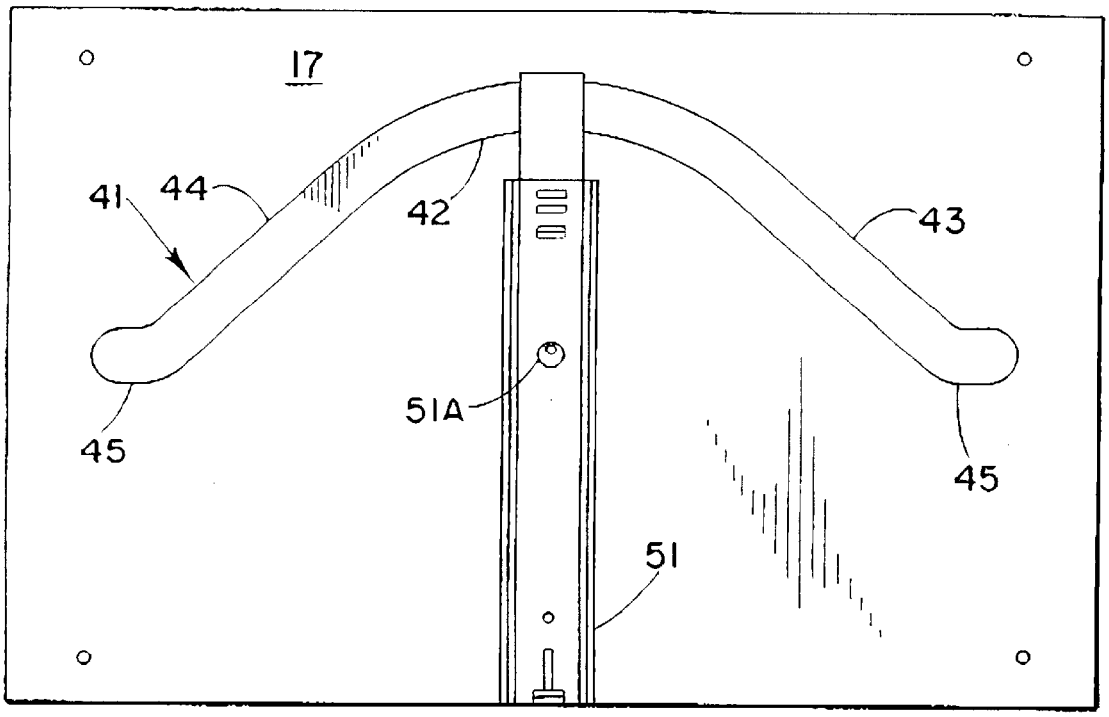
Figure 14:
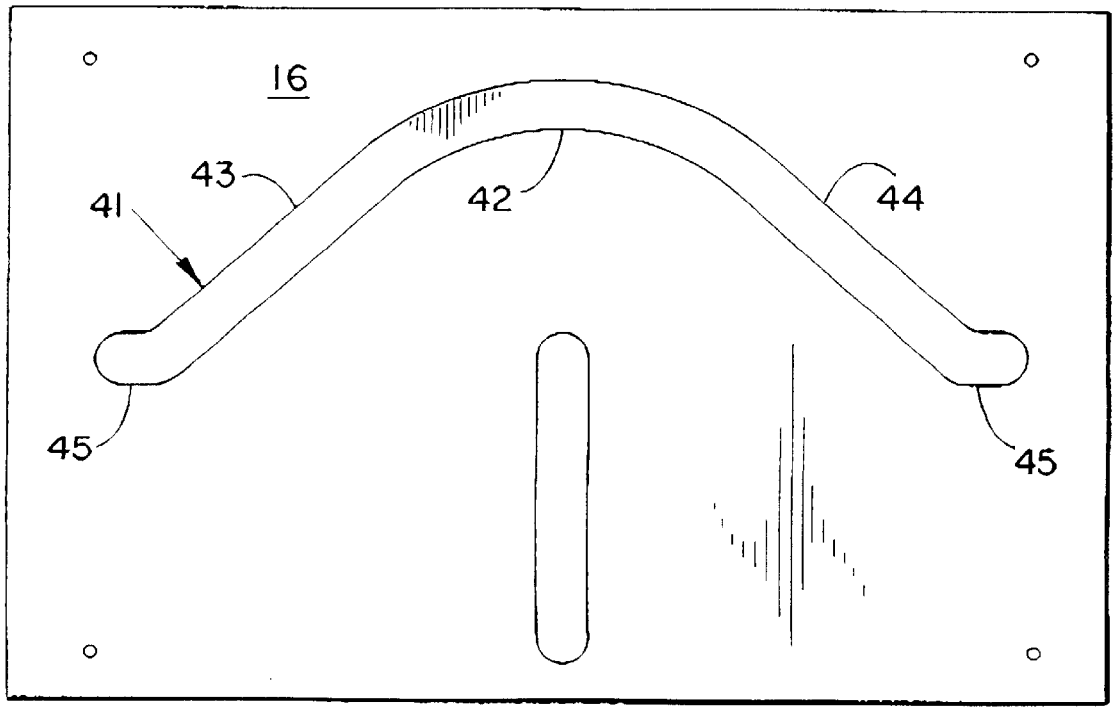
Figure 13A:
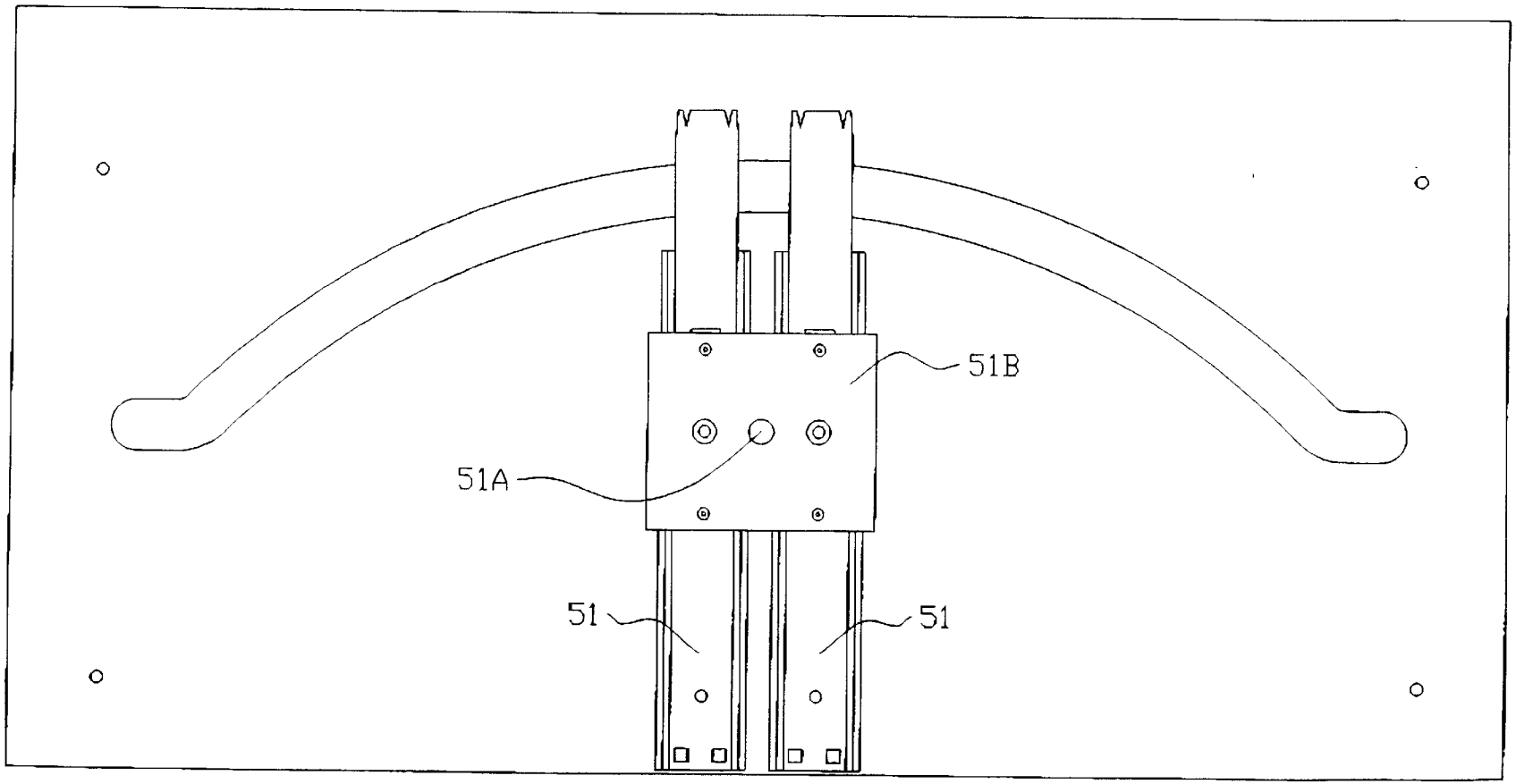
Figure 15:
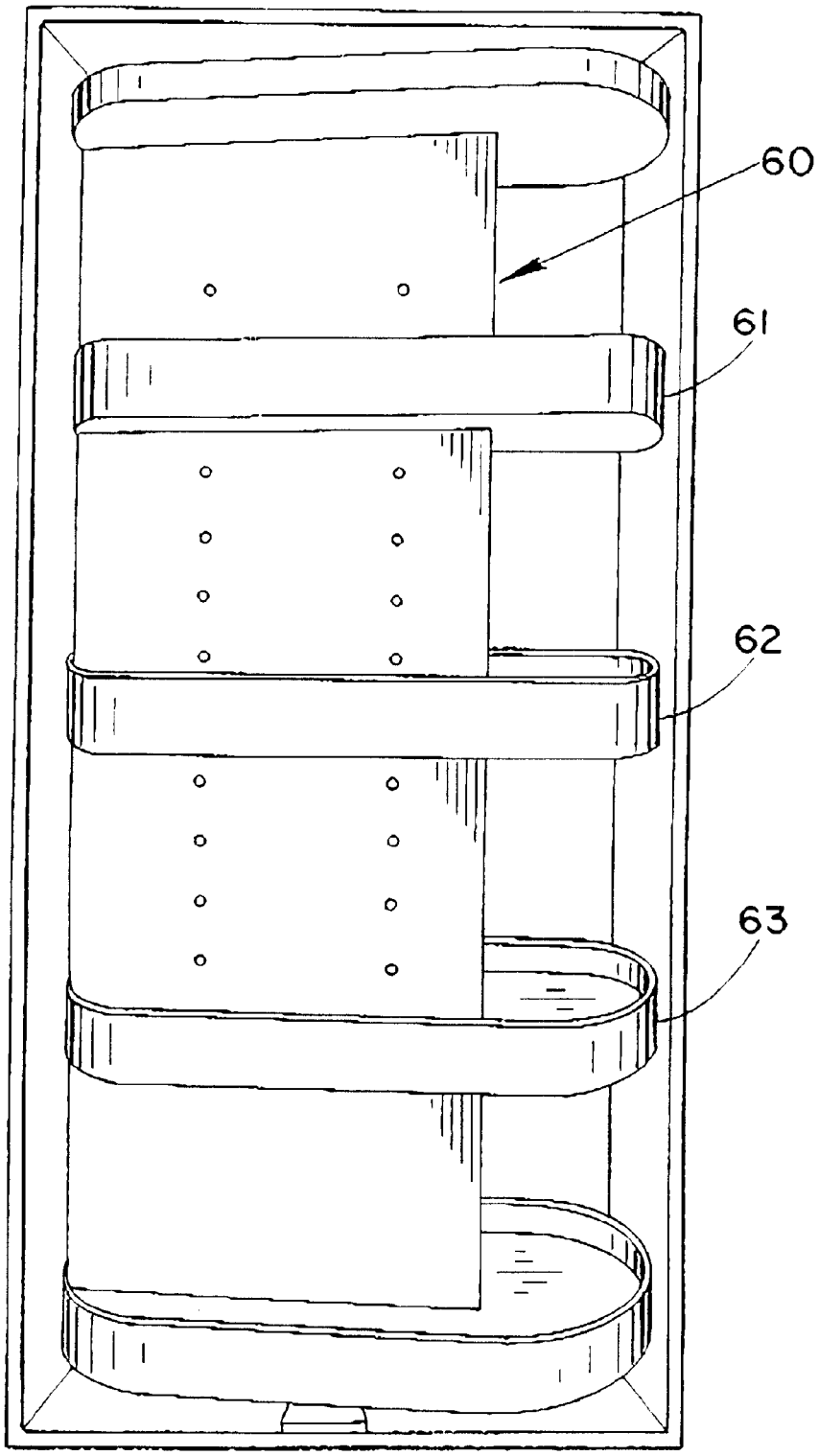
Figure 16:
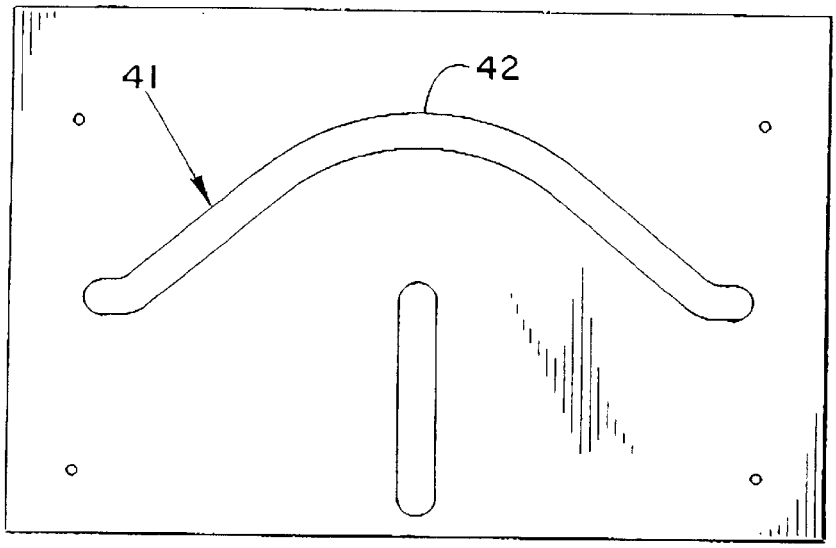
Figure 17:
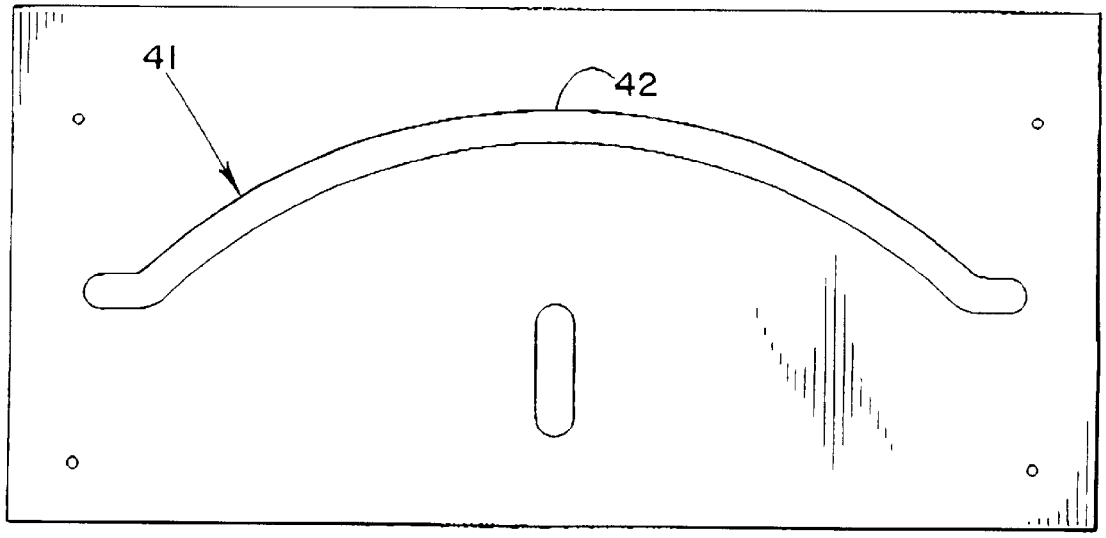

FIG. 3 is an exploded front elevational view illustrating hardware components for a three shelf unit including a top support bracket, a bottom support bracket, and three intermediate shelf support brackets, with the shelf units for the bottom support and intermediate brackets being removed, with the lateral support spine or post being shown removed from the assembly, and with the cam followers being shown prior to removal of those not being required for the finished assembly;

FIG. 4 is a detail side elevational view of the primary support bracket, and illustrating the features of the integral guide followers formed therewith;

FIG. 4A is a detailed side elevational view, partially broken away, of the bottom or primary support bracket with the leveling set screw being shown in exploded form, and illustrating the features of the integral guide followers along with the level adjusting load compensating set screw adjustment device for use in connection with the present invention;

FIG. 4A1 is a view similar to FIG. 4A, partially broken away, and illustrating the level adjusting load compensating set screw in detached form and on an enlarged scale;

FIGS. 5 and 6 are end and top views respectively of the bracket illustrated in FIG. 4, with the guide followers being illustrated in phantom in FIG. 6;

FIG. 5A is a vertical sectional view taken along the line d in the direction of the arrows 5A—5A of FIG. 4;

FIG. 5A1 is a vertical sectional view taken along the line and in the direction of the arrows 5A1—5A1 of FIG. 4A1;

FIG. 7 is a detail elevational view, partially broken away, of the top support bracket, and illustrating the detail of the integral guides therewith, and showing the spring biased locking eccentric associated therewith in detail form detached from the assembly of FIG. 7;

FIG. 8 is an end view, partially broken away, of the bracket illustrated in FIG. 7;

FIG. 9 is a top view of the bracket illustrated in FIG. 7 showing the configuration of the guide followers;

FIG. 10 is a detail elevational view, partially broken away, of the intermediate ate shelf support bracket;

FIGS. 11 and 12 are end and bottom plan views respectively of the bracket illustrated in FIG. 10, with FIG. 11 being partially broken away;

FIGS. 13 and 14 are bottom and top plan views of the bottom and top guide channels respectively, and showing these guide channels as configured on the upper and lower panels of the cabinet enclosure;

FIG. 13A is a plan view of a lower panel of the cabinet enclosure utilizing a pair of laterally disposed linear support bearings;

FIG. 15 is a front perspective view of a modified embodiment of the present invention incorporating a modified post; and FIGS. 16 and 17 are top plan views of the top guide channels illustrating the modified configurations utilized for accommodating cabinet enclosures of different widths.

DESCRIPTION OF THE PREFERRED EMBODIMENT

Figure 2:
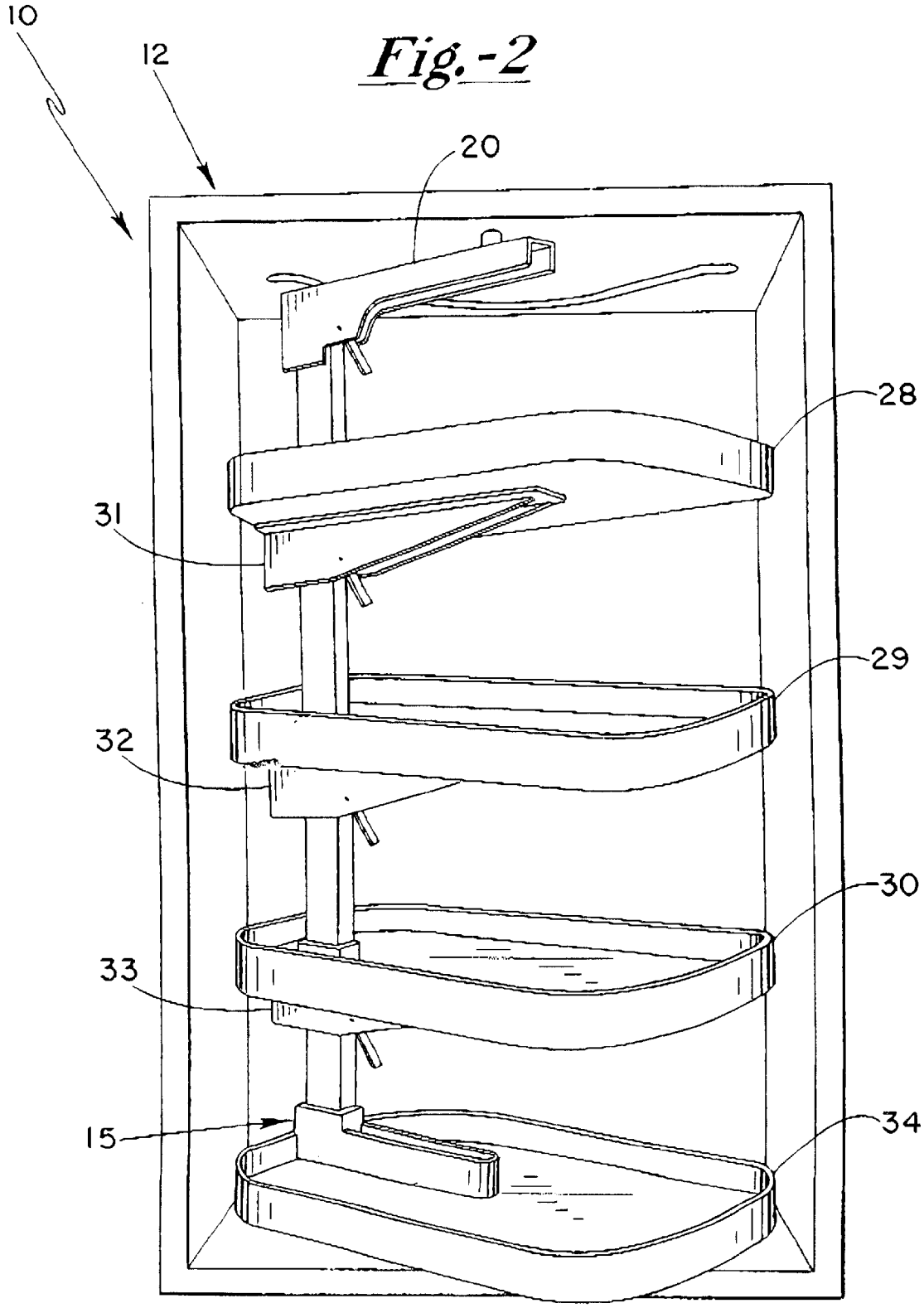
FIG. 2 is a view similar to FIG. 1, and illustrating the reversible shelving unit intermediate its fully opened and closes dispositions.

In accordance with the preferred embodiment of the present invention, and with particular attention being directed to FIGS. 1–3, the assembly generally designated 10 comprises a reversibly positionable shelving unit generally at 11 housed within enclosure 12. Means generally designated 15 are provided for rotatably mounting the shelving unit within the enclosure 12. Enclosure 12 includes upper and lower panels 16 and 17 respectively along with laterally disposed end panels 18—18.

With attention now being directed to the reversible shelving unit 11, mounting means 15 consists of a frame with opposed top and bottom supports 20 and 21 respectively, each including top and bottom support brackets such as at 22 and 23 respectively. Also, as is illustrated in FIG. 1, an upright spine or support post 24 is provided laterally of the reversible assembly 11, with the spine 24 being rigidly secured to and extending between the opposed top and bottom supports 20 and 21 respectively. Preferably, spine or support post 24 is arranged generally medially of the shelf assembly, and hence medially of supports 20 and 21 and is received in box-like openings or receivers as at 15A—15A, with upper and lower supports having support cups as at 15B and 15C. Both top and bottom supports 20 and 21 have followers coupled thereto, with the followers being designated generally at 25 and 26, with details of these followers being disclosed in greater detail hereinafter.

It will be appreciated that the shelving unit of the present invention may be fabricated on a mass-production basis while utilizing a standard length spine or support post 24. Since the structures have applicability for shelf assemblies of a variety of heights, the spine or support post 24 can be provided in a length which is suited for typical units of the greatest height, and cut to length at assembly.

A plurality of shelves such as those designated 28, 29 and 30 are coupled to support members 31, 32 and 33 respectively by fasteners such as screws through screw receiving bores 31C—31C for example (FIG. 12). For securing the individual shelf unit in further engagement with the bracket, shelf receiving flanges 22A and 22B are provided (see FIG. 6), with mating flange receiving grooves being formed along the base of each of the individual shelves. Additionally, shelf 34 is preferably mounted on bottom support 21, and serves the function of a conventional shelf, as do shelves 28, 29 and 30. In order to lockingly couple or engage the shelves 28, 29 and 30 to the support post 24, a spring biased eccentric assembly generally designated 35 is provided for each. A spring biased cam or eccentric 36, in turn, releasably, frictionally, and grippingly engages post 24 about its outer eccentric peripheral surface as at 37. In order to provide for appropriate rotary motion of eccentric camming elements 36, lever or pin 38 is provided for convenient finger gripping engagement. Also, in order to provide a rotary spring bias force, a spring means 39 is provided as illustrated in FIG. 7. Spring 39 is accordingly coupled between camming eccentric 38 and bracket or housing 40 of the shelf support bracket such as illustrated at 31–33, each being in combination with a shelf such as shelf 28.

Attention is now directed to FIGS. 13 and 14 where upper and lower guide slots generally at 41—41 are formed in operative relationship on upper and lower panels 16 and 17. These slots incorporate a centrally positioned arcuate segment as at 42, along with laterally extending linear segments 43 and 44, with segments 43 and 44 terminating at and along distally positioned straight segments 45—45. Each of the segments 45—45 is arranged substantially parallel to the longitudinal axis of the shelving assembly, and provides for substantial added transverse stability of the reversible unit when in its normal or closed disposition.

Upper and lower guide slots are each adapted to be coupled to and engage the followers 25 and 26 which are in a the form of a boss and integrally coupled to opposed top and bottom supports 20 and 21 respectively. With attention being directed to top support 20, a pair of follower means are utilized, with centrally disposed followers as at 47—47, and a laterally disposed follower as at 48. In those applications where a linear bearing is employed along the top surface, the outermost follower 47A will be configured so as to engage a stud protruding from the upper linear bearing similarly to those followers 55–58 inclusive of the bracket illustrated in FIG. 4. With the followers being engaged in the guide slots and/or linear bearing, the reversible motion for the shelving unit is facilitated and otherwise made possible.

Bottom support 21 is provided with a centrally disposed linear bearing follower means such as at 50, with follower means 50 being disposed generally centrally of support 21. Linear bearing 51 is, in turn, secured to lower panel 17 and provides primary support for the reversibly positionable shelving unit 11 in its rotary articulated motion. For accommodating heavier loads, such as may be encountered in certain applications, such as the magnitude of the width, and with attention being directed to FIG. 13A of the drawings, a pair of linear bearings 51—51 are secured to the lower panel 17 and are linked together by cross-piece or cross-member 51B having a centrally located mounting point as indicated hereinbelow. With the configuration of the guide slots 41 together with the followers, rotational motion of the reversible shelf unit 11 is accomplished, with lower linear bearing means 51 being telescopically extended outwardly in coordinated motion from the lower or bottom panel 17.

In the configuration of FIG. 13, a single linear bearing 51 is shown for supporting the base forwardly of the cabinet structure as it swivels and/or moves through its reversing arc. As the length of the shelving arrangement increases, the load to be supported by the linear bearing assembly such as at 51 increases substantially. Accordingly, in those instances where the cabinetry and shelf assembly extends to a width of about 21" or greater and as shown in FIG. 13A, a pair of parallelly arranged linear bearings sharing a centrally located common mounting point such as at 51A to be received in and engage follower 26. Thus, those commonly and traditionally utilized shelving units having widths of, for example, 15", 18", 21–, or 24" can all be accommodated with the reversible assembly of the present invention, with the loads from the wider widths being accommodated by a pair of linear bearings (see FIG. 13A).

In order to enhance the rigidity and strength of primary support 21, a pair of laterally extending support ribs are provided as at 21A and 21B respectively (see FIG. 6). These reinforcing ribs are preferably arranged in equally and oppositely disposed relationship to the central axis of support 21, and together form a receptacle, pocket, or other enclosure for convenient storage of items such as documents representing recipes, daily reminders, or other items which may be conveniently stored and retrieved in the shelf unit 11.

In certain instances, such as in a wider cabinet, it may be desirable to employ a matching linear bearing along the upper panel, with this bearing being positioned immediately and in vertical axial alignment with lower linear bearing 51. Appropriate follower means are provided on top support 20 to achieve matching coordinated and appropriate motion of the shelving unit 11.

In order to accommodate a variety of sizes of reversible shelf units, a plurality of followers are provided along the surfaces of top and bottom supports 20 and 21 respectively. These individual follower means are illustrated for example at 55, 56, 57 and 58 (see FIG. 4) and 47 and 47A (see FIG. 7). Each of these individual follower means is designed to accommodate a particular width shelving assembly, for example, shelving assemblies having the widths identified hereinabove as 15", 18", 21", or 24". When the dimensional configuration of the application for the support is known or ascertained, the appropriate follower element to be retained is defined and designated, and then it becomes necessary to remove those followers which are not needed. For example, in a cabinet assembly having a dimension which utilizes follower designated 58, the remaining followers including followers 55, 56 and 57 are removed by milling, cutting, or other suitable operation so as to render the guide slot contacting surface free of followers except for the follower actually employed.

FIGS. 16 and 17 are plan views of guide channels for the upper panels of cabinet enclosures of different widths. With attention being directed to FIG. 16, guide slot 41 is formed in upper panel 16 with the centrally positioned arcuate segment 42 having a radius which generates appropriate rotary motion in the reversible shelving unit as it is moved and/or repositioned. As illustrated in FIG. 17, the centrally positioned arcuate segment 42 is generated with a longer radius in order to accommodate rotary motion of a reversible shelving unit of greater width than that of FIG. 16.

As has been indicated hereinabove, smooth operation of the reversible assembly generally requires that the bottommost or base shelf 34 and its support bracket 21 must rest along a horizontal plane, parallel to the plane of lower panel 17. However, as the loading increases on the individual superimposed shelves, bottom shelf 15 and its support 21 tend to pivot or move in a counter-clockwise direction from the view of FIG. 4A. The imposition of the load from spine 24 rests upon linear bearing 51. This load will normally tend to rack the assembly, thus interfering with the horizontal relationship with the bottom panel 17. In order to accommodate this racking motion, a slotted zone such as shown at 21D is formed in spine-receiving receptacle 21E in order to accommodate flange nut and set screw adjustment means. Adjustable set screw means 70 is in the form of a screw engaging flange nut 71. This portion of the assembly is utilized to accommodate leveling of the bottom support such as bottom support 21, with the level being controlled by the position of the set screw.

With attention now being directed to FIG. 15 of the drawings, an alternate embodiment of the invention is disclosed. In this embodiment, upright support spine 24 is replaced by upright support spine generally designated 60 which is generally in the form of a wide post. In this alternative embodiment, individual shelves such as illustrated at 61, 62, 63 and 64 are provided, with these shelves being grooved to accommodate and be held in place by the supports extending through spine support 60. It will be observed that a substantial portion or linear extent of the width of the shelving units is accessible from both sides due to the dimensional configuration of support spine 60. The operation of the alternative embodiment of this FIG. 15 is the same as that previously discussed in connection with the embodiments of FIGS. 1–14 inclusive.

It will be appreciated that the specific examples given herein are for purposes of illustration only and are not to be construed as a limitation upon the scope of coverage to which this invention is otherwise entitled.

What is claimed:

1. In a combination comprising a reversibly positionable shelving unit of generally rectangular shape housed within an enclosure, a support means for rotatably mounting said shelving unit within said enclosure, and with said enclosure including upper and lower panels and laterally disposed opposed end panels, the combination being characterized in that:

(a) said reversible shelving unit consists of a frame with opposed top and bottom support, each with a laterally disposed support post engaging pocket, a generally upright support post rigidly secured to and extending between said opposed top and bottom support and disposed adjacent one of said lateral edge surface medially between opposed front and rear edge surfaces, and with the outer surfaces of said top and bottom supports having followers coupled thereto;

(b) a plurality of shelves infinitely adjustably positioned in vertically spaced relationship along said upright support post, with each shelf being coupled to a camming support means for releasably frictionally and grippingly engaging said post and with each of said camming support means locking a shelf for unidirectional cantilevered support along said post;

(c) matching upper and lower guide slots, each operatively coupled to one of said upper and lower panels, said guide slots being of matching configuration and adapted to engage said follower means, and a linear bearing operatively secured to said lower panel and in engagement with the top surface of said bottom supports;

(d) said top and bottom supports each having a proximal slot follower means coupled thereto, and with at least said bottom support having a centrally disposed linear bearing follower means, with said guide slots, linear bearings and follower means being configured so that rotational motion of said shelf unit causes said linear bearing means to telescopically extend outwardly in coordinated motion from the front edges of each of said top and bottom panels; and (e) the arrangement and configuration of said upper and lower guide slots and said linear bearing means being such that rotational motion of the shelf unit causes the follower means of said top and bottom supports to move said reversible shelf through its motion path.

2. The combination of claim 1 wherein said guide slots are configured to extend laterally away at equally diverging acute angles from a centrally disposed apex toward the front edge surfaces along first segments of substantially equal length to a juncture point, and extending from said juncture point along second segments of substantially equal lengths generally parallel to the front edge of said bottom panel.

* * * * *